US009177747B2

(12) United States Patent
Littlechild et al.

(10) Patent No.: US 9,177,747 B2
(45) Date of Patent: Nov. 3, 2015

(54) FLASH LAMP, A CORRESPONDING METHOD OF MANUFACTURE AND APPARATUS FOR THE SAME

(71) Applicant: Heraeus Noblelight Ltd., Cambridge (GB)

(72) Inventors: John Littlechild, Caldecote (GB); Martin Brown, Soham (GB)

(73) Assignee: Heraeus Noblelight GmbH, Hanau (DE)

( * ) Notice: Subject to any disclaimer, the term of this patent is extended or adjusted under 35 U.S.C. 154(b) by 0 days.

(21) Appl. No.: 14/540,432

(22) Filed: Nov. 13, 2014

(65) Prior Publication Data

US 2015/0072584 A1 Mar. 12, 2015

Related U.S. Application Data

(62) Division of application No. 13/503,944, filed as application No. PCT/EP2010/006630 on Oct. 29, 2010, now Pat. No. 8,922,119.

(30) Foreign Application Priority Data

Nov. 23, 2009 (GB) ..... 0920440.5

(51) Int. Cl.

| | |
|---|---|
| ***H01J 9/02*** | (2006.01) |
| ***H01J 9/20*** | (2006.01) |
| ***H01J 61/35*** | (2006.01) |
| ***H01J 61/54*** | (2006.01) |
| ***H01J 61/90*** | (2006.01) |

(52) U.S. Cl.

CPC ... *H01J 9/02* (2013.01); *H01J 9/20* (2013.01); *H01J 61/35* (2013.01); *H01J 61/545* (2013.01); *H01J 61/90* (2013.01)

(58) Field of Classification Search

None

See application file for complete search history.

(56) References Cited

U.S. PATENT DOCUMENTS

| | | | | |
|---|---|---|---|---|
| 3,829,732 | A | 8/1974 | Sysun et al. | |
| 4,004,173 | A * | 1/1977 | Rigden | 313/317 |
| 2004/0062035 | A1 * | 4/2004 | Hayne et al. | 362/101 |
| 2006/0192490 | A1 | 8/2006 | Ogino et al. | |
| 2010/0213840 | A1 * | 8/2010 | Nishiyama et al. | 313/635 |
| 2012/0274205 | A1 * | 11/2012 | Littlechild et al. | 313/567 |

FOREIGN PATENT DOCUMENTS

| | | | |
|---|---|---|---|
| FR | 1409650 | A | 8/1965 |
| JP | 57-202057 | A | 12/1982 |
| JP | 58-225553 | A | 12/1983 |

(Continued)

OTHER PUBLICATIONS

Int'l Search Report issued Feb. 2, 2011 in Int'l Application No. PCT/EP2010/006630.

(Continued)

*Primary Examiner* — Ashok Patel

(74) *Attorney, Agent, or Firm* — Panitch Schwarze Belisario & Nadel LLP

(57) ABSTRACT

A flash lamp is disclosed including an insulative envelope containing a gas and housing a pair of arcing electrodes and characterized by an instance of isolated conductive material being formed at a predetermined location on the inside of the envelope adjacent an electrode. Further disclosed is a corresponding method of manufacturing a flash lamp and apparatus for the same.

2 Claims, 1 Drawing Sheet

(56) References Cited

FOREIGN PATENT DOCUMENTS

| | | | |
|---|---|---|---|
| JP | 59-148229 | A | 8/1984 |
| JP | 09-320533 | A | 12/1997 |
| JP | 2001-076617 | A | 3/2001 |
| JP | 2003-036813 | A | 2/2003 |
| WO | 02095792 | | 11/2002 |

OTHER PUBLICATIONS

Search Report issued Feb. 19, 2010 in GB Application No. GB0920440.5.
Office Action issued Jun. 10, 2014 in U.S. Appl. No. 13/503,944.
Office Action issued Apr. 14, 2015 in CN Application No. 201080052788.0.

* cited by examiner

FLASH LAMP, A CORRESPONDING METHOD OF MANUFACTURE AND APPARATUS FOR THE SAME

CROSS-REFERENCE TO RELATED APPLICATIONS

This application is a Divisional of U.S. application Ser. No. 13/503,944 filed Apr. 25, 2012, which was a Section 371 of International Application No. PCT/EP2010/006630, filed Oct. 29, 2010, which was published in the English language on May 26, 2011, under International Publication No. WO 2011/060878 A1, the entire disclosures of all of which are incorporated herein by reference.

BACKGROUND OF THE INVENTION

This invention relates to a flash (or arc) lamp comprising an insulative envelope containing a gas and housing a pair of arcing electrodes; and to a corresponding method of manufacturing such a flash lamp and apparatus for the same.

As is known, the ignition/triggering properties of arc and flash lamps are notoriously inconsistent from one batch of lamps to another and from one lamp to another.

The triggering process is complex and requires an initial breakdown or ionization in the lamp gas (e.g., xenon and krypton). Most triggering schemes use a trigger transformer to produce the high voltage required to achieve the ionization. Such ionization can typically be seen as a thin streamer between the two electrodes and forms the conductive path which allows a main energy storage capacitor to discharge across the electrodes, thus leading to an intense flash.

To improve the triggering process, it is known to sputter part of the electrode material on to the inner surface of the envelope near to the electrode. As a consequence, the voltage required to ignite a lamp can be significantly lowered.

However, such sputtering can be disadvantageous in that there can be a reduction in lifetime due to the sputtered material blocking light transmission from the plasma (leading to subsequent deglazing or recrystallization of the envelope material). Also, the sputtering process can damage the electrode surface and reduce the life of the lamp as the lamp plasma itself is used for the sputtering. Furthermore, the sputtering process needs to be carried out during or prior to the gas filling of the lamp, which is normally a lengthy and unpredictable process. For example, it can be achieved by reverse polarity running the lamp at a low gas pressure.

BRIEF SUMMARY OF THE INVENTION

In accordance with a first aspect of the present invention, there is provided a flash lamp comprising an insulative envelope containing a gas and housing a pair of arcing electrodes, characterized by an instance of isolated conductive material being formed at a predetermined location on the inside of the envelope adjacent an electrode. A plurality of such instances of isolated conductive material may also be formed.

The pseudorandom forming of such material by sputtering and the subsequent inconsistent triggering can be avoided if deliberate and controlled forming of such material is employed, i.e., forming the material at a predetermined location (as opposed to a pseudorandom location with sputtering) and/or forming the material in a predetermined shape (including in a geometric pattern).

In embodiments where the envelope is elongate, it may be preferable for at least one instance of isolated conductive material to be formed on the inside of the envelope in a region bounded by respective planes orthogonal to the direction of elongation and passing through the extremities of an electrode, especially, immediately adjacent the arcing end of that electrode.

In accordance with a second aspect of the present invention, there is provided a corresponding method of manufacturing a flash lamp comprising the step of providing an insulative envelope containing a gas housing a pair of arcing electrodes in the insulative envelope, characterized by the step of forming an instance of isolated conductive material at a predetermined location on the inside of the envelope adjacent an electrode.

In particular, such a method may employ localized heating (e.g., using a laser) of an area of an electrode to form at least one instance of isolated conductive material adjacent the heated area. Using such a technique, it is possible to the shape of the conductive material by movement of the external heat source relative to an electrode.

In accordance with a third aspect of the present invention, there is provided an apparatus for manufacturing a flash lamp comprising a receptacle for receiving a flash lamp comprising an insulative envelope containing a gas and housing a pair of arcing electrodes; and a heat source (e.g., a laser) configured to heat a localized area of an electrode of the flash lamp in order to cause evaporated electrode material to form on the envelope, adjacent the heated area.

Ideally, either the receptacle or the heat source is able to move relative to the other in order to determine the shape of the conductive material formed.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
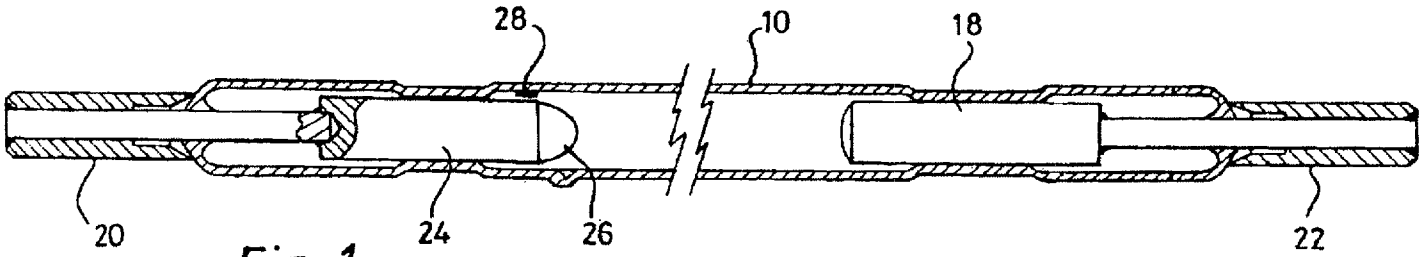
FIG. 1 shows, schematically, a flash lamp according to an embodiment of the present invention.

Referring to FIG. 1, a flash lamp is shown having a quartz envelope 10 housing a lanthanated tungsten cathode 24 and an anode 18 connected to respective electrical connectors 20, 22. The electrodes could equally have been tungsten, thoriated tungsten and many other metals or metal alloys. The envelope 10 is optionally provided with two narrowing sections which approach the electrodes 18, 24 to a distance of approximately 15 to 20 microns and which provide for cooling of the electrodes in use.

In accordance with the present invention and to improve the triggering process, a conductive deposit 28 is formed adjacent the electrode tip 26.

Figure 2:
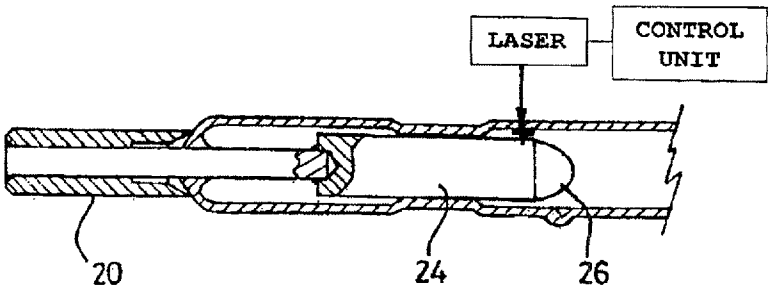
FIG. 2 shows, schematically, the manufacture of the flash lamp of FIG. 1.

Referring to FIG. 2, a method of manufacture of such a lamp is illustrated. A laser is provided, controlled by a corresponding control unit, for locally heating a small area of the tungsten cathode 24 in order to evaporate electrode material for subsequent deposition on the quartz envelope 10.

Although not shown, the shape of the conductive deposit can be defined by the movement of the laser relative to the lamp to get a desired effect.

Table 1 below summarizes the results of experiments conducted on twelve batches of flash lamps. Without a conductive deposit, the required trigger voltage is high (up to 10 kV) and somewhat inconsistent between batches. However, after forming the conductive deposits in accordance with the present invention, it is evident that the triggering voltage is both much reduced and consistent.

TABLE 1

Experimental Results

| Batch No. | Trigger [kV] before | Trigger [kV] 1st attempt | Trigger [kV] 2nd attempt | Trigger [kV] avg. | Change (%) |
|---|---|---|---|---|---|
| 41/13. | 10.00 | 2.25 | 2.25 | 2.25 | −78 |
| 42/20 | 7.00 | 3.25 | 3.00 | 3.13 | −55 |
| 42/25 | 7.00 | 2.25 | 2.25 | 2.25 | −68 |
| 43/10 | 11.00 | 4.00 | 3.50 | 3.75 | −66 |
| 43/11 | 9.75 | 3.25 | 3.25 | 3.25 | −67 |
| 43/25 | 10.00 | 3.00 | 2.30 | 2.65 | −74 |
| 44/29 | 6.25 | 4.00 | 3.25 | 3.63 | −42 |
| 44/31 | 6.50 | 4.00 | 3.00 | 3.50 | −46 |
| 46/29 | 8.50 | 4.00 | 3.00 | 3.50 | −59 |
| 47/21 | 11.00 | 4.50 | 4.00 | 4.25 | −61 |
| 47/24 | 7.50 | 3.00 | 3.00 | 3.00 | −60 |
| 47/25 | 10.00 | 4.50 | 3.00 | 3.75 | −63 |

Whilst the above embodiment describes direct heating by a laser, it will be appreciated that other direct heat sources and indirect heat sources (such as by high frequency inductive heating) could be used to form a shaped deposit of conductive material (especially where a small exposed structure is provided so as to be particularly susceptible to inductive heating, e.g., a small structure of tungsten on top of the electrode to be "heated away").

Furthermore, the conductive deposit can be formed during lamp manufacture, e.g., before filling with gas, or when the lamp is otherwise fully formed. Also, in the embodiment, the conductive deposit is formed from electrode material, but it could be from another material (or different alloy grade) during lamp manufacture. For example, one may first form an instance of isolated conductive material at a predetermined location on the electrode and then heat that instance of isolated conductive material on the electrode, e.g., by baking, to cause it to evaporate and condense on the adjacent envelope. A sol-gel type process to achieve a similar effect could also be used.

The above embodiment describes an anode and cathode arrangement, i.e., DC, with the conductive deposit adjacent the cathode. The conductive deposit or additional conductive deposits could also be adjacent the anode. Similarly, the above is also applicable to AC lamps having electrodes (i.e., not an anode and cathode per se).

Other variations on the above embodiments would also suggest themselves to those skilled in the art.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An apparatus for manufacturing a flash lamp comprising a receptacle for receiving a flash lamp comprising an insulative envelope containing a gas and housing a pair of arcing electrodes; and a laser configured to heat a localized area of one of the electrodes of the flash lamp in order to cause evaporated electrode material to form on the envelope, adjacent the heated area.

2. The apparatus according to claim 1, wherein either the receptacle or the laser is able to move relative to the other in order to determine the shape of the conductive material formed.

* * * * *